United States Patent [19]

Shah

[11] 3,994,122

[45] Nov. 30, 1976

[54] MIXED CROSS-SECTION STAPLE FILAMENT MIXTURES AND YARN THEREFROM

[75] Inventor: Chandrakant S. Shah, Seaford, Del.

[73] Assignee: E. I. DuPont de Nemours and Company, Wilmington, Del.

[22] Filed: Mar. 20, 1975

[21] Appl. No.: 560,117

[52] U.S. Cl. ..... 57/140 BY; 57/157 R

[51] Int. Cl.[2] ..... D02G 3/04

[58] Field of Search..... 57/140 R, 140 BY, 140 J, 57/34 B, 157 R

[56] References Cited

UNITED STATES PATENTS

| | | | |
|---|---|---|---|
| 2,939,202 | 6/1960 | Holland | 57/140 J |
| 3,033,240 | 5/1962 | Bottorf | 57/34 B X |
| 3,097,416 | 7/1963 | McKinney | 57/140 R |
| 3,220,173 | 11/1965 | Pitzl | 57/140 R |
| 3,249,669 | 5/1966 | Jamieson | 57/140 J |
| 3,802,177 | 4/1974 | Sekiguchi | 57/140 BY |

*Primary Examiner*—Donald E. Watkins

[57] ABSTRACT

Crimped polyamide staple filament mixtures and yarn therefrom having a high bulk, high luster free from objectionable sparkle and glitter, and improved resistance to soiling are produced. The novel yarn is a blend of trilobal polyamide filaments having different cross-sections, i.e., modification ratios, within specified ranges and specified proportions for each cross-sectional type of filament. This yarn has particular utility as carpet yarn. The method for producing the novel yarn comprises blending the above-described mixed cross-section filaments.

12 Claims, 1 Drawing Figure

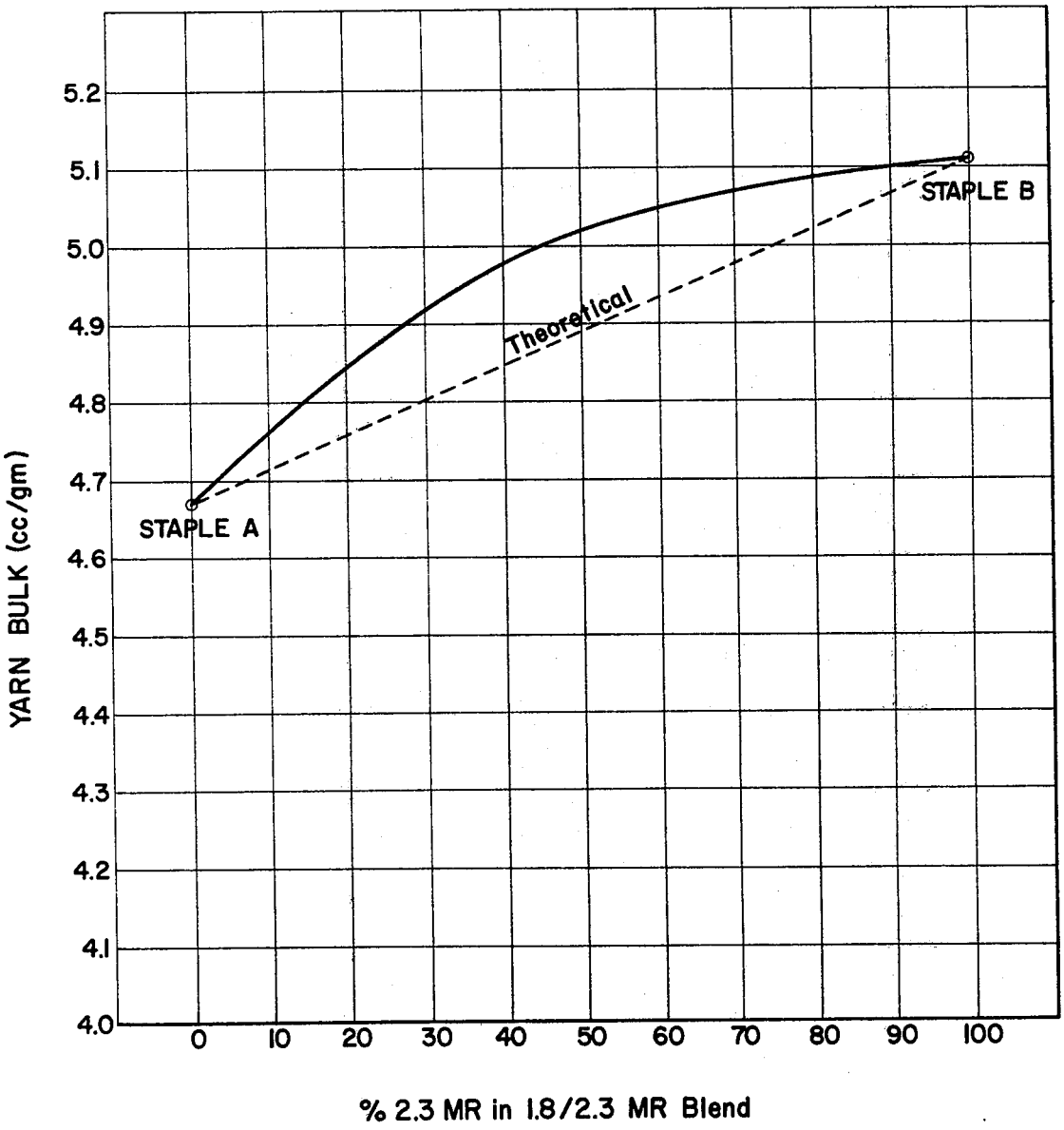
5.2
5.1
5.0
4.9
4.8
4.7
4.6
4.5
4.4
4.3
4.2
4.1
4.0
YARN BULK (cc/gm)
STAPLE A
STAPLE B
Theoretical
0
10
20
30
40
50
60
70
80
90
100
% 2.3 MR in 1.8/2.3 MR Blend

MIXED CROSS-SECTION STAPLE FILAMENT MIXTURES AND YARN THEREFROM

BACKGROUND OF THE INVENTION

1. Field of the Invention

The invention relates to crimped polyamide staple filament mixtures and yarns therefrom having an excellent overall combination of high bulk, high luster without undesirable sparkle and glitter, and improved resistance to soiling. These yarns are useful as carpet yarns.

2. Description of the Prior Art

Yarns produced from synthetic polymers in which the filaments are multilobal in cross-section have been found to offer substantial improvements with respect to bulk, luster, and resistance to soiling. Such yarns are described in U.S. Pat. Nos. 2,939,201; 2,939,202 and 3,691,749. These multilobal cross-section yarns possess a range of the above-mentioned properties which are useful in carpet yarns. For example, some yarns exhibit good bulk characteristics but have poor luster and/or poor soil resistance. Other yarns exhibit good luster but have poor bulk characteristics. Other yarns have too much luster and exhibit a high degree of sparkle which may be undesirable from an aesthetic point of view. A problem of non-uniform appearance in uncrimped continuous filament trilobal textile yarns is discussed and a solution is set forth in U.S. Pat. No. 3,220,173.

While the prior art was aware of and concerned with bulk, luster and soil resistance, a need existed for a carpet yarn having a unique combination of these properties.

SUMMARY OF THE INVENTION

This invention resides in providing a crimped polyamide staple filament mixture comprising (a) 40–60% by weight of trilobal filaments having a modification ratio within the range of 1.6–1.9, and (b) 40–60% by weight of trilobal filaments having a modification ratio within the range of 2.2–2.5. Also provided is a crimped polyamide staple yarn having high bulk, high luster and improved resistance to soiling, comprising a blend of (a) 40–60% by weight of trilobal filaments having a modification ratio within the range of 1.6–1.9, and (b) 40–60% by weight of trilobal filaments having a modification ratio within the range of 2.2–2.5.

In a preferred embodiment, the above-identified trilobal filaments contain less than 1% of a delusterant such as polyethylene oxide.

This invention broadly involves a method for producing a crimped polyamide staple filament mixture by mixing (a) 40–60% by weight of trilobal filaments having a modification ratio within the range of 1.6–1.9, and (b) 40–60% by weight of trilobal filaments having a modification ratio within the range of 2.2–2.5. In addition, this invention involves a method for producing crimped polyamide staple yarn, having high bulk, high luster and improved resistance to soiling by a combination of steps including melt-spinning continuous polyamide filaments, drawing the filaments, crimping the filaments, cutting the crimped filaments into staple, and optionally combining with other staple, wherein the improvement resides in blending filaments comprising (a) 40–60% by weight of trilobal filaments having a modification ratio within the range of 1.6–1.9, and (b) 40–60% by weight of trilobal filaments having a modification ratio within the range of 2.2–2.5, said blending being performed during one or more stages in the production of staple yarn.

BRIEF DESCRIPTION OF THE DRAWING

The single FIGURE of the drawing is a graphic representation of the amount of theoretical bulk and actual bulk exhibited by yarns having various cross-section blends.

DETAILED DESCRIPTION

The terms modification ratio (MR) and trilobal filaments as used herein are defined in accordance with conventional terminology, such as described in U.S. Pat. No. 2,939,201.

The MR of each filament type is determined by measuring 10 filaments of the particular filament type and calculating the average. No greater than 10% of the filaments should depart more than 0.15 MR units from the average.

The term mixture as used herein means any combination or association of two or more staple filament types distributed throughout a staple mass, said mass not being a yarn.

The term blend as used herein means any combination or association of two or more staple filament types, randomly distributed throughout a staple yarn.

The unique combination of properties attributable to the yarn of this invention is due to the utilization of the particular filaments of specified trilobal cross-section (MR) and the proportions thereof. More specifically, one required group of filaments must have modification ratios within the range of 1.6–1.9. When filaments are used having modification ratios outside of this range, insufficient luster and soil resistance is produced in the ultimate yarn.

The other group of required trilobal filaments must have modification ratios within the range of 2.2–2.5. The utilization of filaments having modification ratios outside of this range produces too little bulk, or too little luster and soiling resistance.

Another critical requirement of this invention is that each of the two types of filaments in the mixture or blend be present in amounts within the range of 40–60%. The usage of amounts of either group of filaments outside of these specific ranges results in yarn not having the overall combination of desired properties. For example, the use of more than 60% of filaments having modification ratios within the range of 1.6–1.9 results in a yarn having insufficient bulk. At the other extreme, the use of more than 60% filaments having modification ratios within the range of 2.2–2.5 results in yarn having insufficient luster and poor soil resistance. However, it should be understood that minor amounts, i.e., about 5% or less, of other filaments may be present in the mixture or blend. For instance, 1% or less of bicomponent staple filaments having a concentric conductive core as described in Hull, U.S. Pat. No. 3,803,453 may be added to impart antistatic properties to the product. Such filaments have a round exterior (1.0 MR) and in small amounts have no substantial effect on the bulk or luster of the product. Alteratively, Alternatively, 5% of eccentric crimpable bicomponent staple fibers may be added as disclosed in Chamberlain & Botts, U.S. Pat. No. 3,469,387 to give added bulk. Examples of other natural and synthetic filaments includable in the mixture or blend are wool, polyester, polyethylene, polypropylene, and mixtures thereof.

The filaments of this invention are preferably polyamide, although other crimpable polymeric filaments such as polyester and polypropylene having about the same luster range as polyamide may be employed. Any of the generally well known polyamides may be used, including polyhexamethylene adipamide (66 nylon), polycaproamide (6 nylon) and copolymers thereof. As stated above, these filaments may also be mixed with other natural or synthetic filaments.

Optional amounts of conventional delusterants may also be present in the filaments. In general, from 0–10% by weight of a delusterant may be utilized. For example, up to 1% titanium dioxide may be used. When polyethylene oxide as described in U.S. Pat. No. 3,475,898 is used as delusterant, it is common to use from 2–10%. However, this amount is unnecessary in the present invention. Due to the unique combination of properties produced by utilizing blends of filaments having the specified modification ratios, very small amounts of polyethylene oxide provide the desired effect. Specifically, 0.25%–1% polyethylene oxide may be used in the filaments and still provide the necessary delustering. While polyethylene oxide, e.g., as described in U.S. Pat. No. 3,475,898, is preferred, other conventional delusterants such as titanium dioxide, polyethylene, etc. may be used alone or in combination. Particle sizes of these delusterants and method of incorporating them into the filaments are those well known in the art and not critical to this invention.

Another essential feature of this invention is that the filaments be crimped. This can be accomplished by any of the well known methods, for example, by the use of a stuffer crimper such as disclosed by U.S. Pat. No. 2,311,174. Other types of crimping devices and mechanisms may also be used, such as gear crimping or jet bulking. Crimped filaments are necessary in this invention to provide the required amount of bulk in the yarn. Therefore, it is preferred that at least 6 crimps per inch be present in the individual filaments.

The staple yarn of this invention has its main utility in carpet yarn. Consequently, the denier of the individual trilobal filaments can be within the range of those commonly used for carpets, e.g., 10–20 denier per filament. It is preferred that the two major components be roughly the same denier per filament.

In the process of this invention, the novelty resides in the mixing or blending steps wherein groups of filaments having the specified modification ratios are joined to form the products of this invention. Regarding the production of yarn, the other steps for producing staple yarn are all conventional, well known in the art and not critical in sequence to the successful production of the yarn. Consequently, the steps of melt-spinning continuous polyamide filaments, drawing the filaments, crimping the filaments, cutting the crimped filaments into staple and, optionally, combining with other staple are all well known operations which need no further amplification.

As stated above, mixing or blending is the critical step in the process of this invention. This can be accomplished, for example, within the spinneret, by using alternate spinnerets, or in the formation of tow. These would be referred to as mixing during cospinning. Another way to accomplish the mixing would be to co-draw separate groups of filaments. Additionally, mixing at the staple cutter is acceptable. Alternatively, filaments could be processed through spinning, drawing and cutting as separate entities and then blended together prior to being made into yarn. Card-blending would be very acceptable for this procedure.

The invention will be illustrated by the following Examples. In the Examples and elsewhere in the specification, all parts, percentages and ratios are understood to be by weight unless specified otherwise.

EXAMPLE 1

Polyhexamethylene adipamide was prepared in the conventional manner. The polymer was melt extruded to form trilobal filaments having a relative viscosity of 68 as described in U.S. Pat. No. 2,939,201. Filaments were quenched by passing air transversely across them and combined into a tow. The tow was drawn at a ratio of 3.75 and stuffer box crimped. The crimped tow was subsequently cut into staple having an average length of 7-½ inches. Staple A, prepared in this manner, was 18 denier per filament, had an average modification ratio of 1.8 and 12 crimps per inch, and contained 0.52% polyethylene oxide and 0.002% titanium dioxide. Staple B, prepared in this manner, was 18 denier per filament, had an average modification ratio of 2.3 and 13 crimps per inch, and contained 0.52% polyethylene oxide and 0.002% titanium dioxide.

Staple A and Staple B were card-blended into the yarns described below in Table I.

TABLE I

| Yarn | Staple A (1.8 MR) | Staple B (2.3 MR) | Yarn Bulk (cc/gm) | Luster | Soil Resistance |
|---|---|---|---|---|---|
| 1 | 100% | — | 4.67 | 7 | 3.0 |
| 2 | 60% | 40% | 4.98 | 8 | 4.4 |
| 3 | 40% | 60% | 5.05 | 9 | 5.0 |
| 4 | 20% | 80% | 5.09 | 12 | 5.0 |
| 5 | — | 100% | 5.11 | 13 | 7.7 |

YARN BULK METHOD

Yarn cylinder bulk was measured on skein dyed yarns which were conditioned for 24 hours at 70° F., 65% relative humidity. A 2 gm. weighed yarn specimen, cut into ½ inch lengths, is placed in a cylinder. A piston exerting 3.1 psi pressure is inserted into the cylinder. After being compressed for 100 seconds, the yarn volume is measured and the specific volume calculated.

LUSTER RANK

Skein dyed yarns were wound on luster cards and illuminated with incandescent light and ordered from lowest luster (highest number) to highest luster (lowest number).

SOIL RESISTANCE

The soil resistance was measured by placing carpet samples, 7-½ inches by 22 inches, in a hallway. A traffic cycle was recorded by an electric counter each time a person walked over the carpet samples. A carpet for removing excess wax and dirt from shoes was placed at each end of the testing area so that a person walking through the area would walk over the carpet before walking over the samples. The positions of the various samples were rotated periodically according to a random table and each sample was turned 180° and cleaned with a commercial vacuum cleaner daily. After 10,000 traffic cycles, the samples were removed from the floor and subjectively ranked for soil resistance by seven people. Ratings were made on a scale from 1 to 10 with a rating of 1 representing best soil resistance, and a rating of 10 representing least soiling resistance.

The drawing represents a plot of bulk versus yarn cross-section (MR) blends utilizing various percentages of Staple A and Staple B. The broken straight line represents the theoretical bulk of yarn prepared from blends of Staple A and Staple B, as the proportions of each Staple were changed from 0 to 100%.

The unexpected synergistic effect caused by the cross-section blends of this invention is exemplified by the curved line between points A and B. It is apparent that the products of this invention afford bulk greater than predicted from the additive relationships of blending Staple A and Staple B (theoretical line). Previously, it was considered that high bulk, high luster and good soil resistance could not be achieved in a single product to this extent.

EXAMPLE 2

Polyhexamethylene adipamide was prepared in the conventional manner. The polymer was melt extruded to form trilobal filaments having a relative viscosity of 68 as described in U.S. Pat. No. 2,939,201. The polymer was extruded from two spinnerets, one which produced filaments having cross-sections of 1.8 MR and the other which produced filaments having crosssections of 2.3 MR. All of the filaments were quenched by passing air transversely across them and combined into a tow. The tow was drawn at a ratio of 3.75 and stuffer box crimped. The crimped tow was subsequently cut into staple (average length of 7-½ inches) to form a staple fiber mixture comprising 50% by weight of trilobal filaments having a modification ratio of 1.8 and 50% by weight of trilobal filaments having a modification ratio of 2.3. All of the filaments were 18 denier per filament and contained 0.46% polyethylene oxide and 0.003% titanium dioxide.

This crimped polyamide staple fiber mixture was then card-blended into a yarn. The resultant yarn had a bulk of 5.03 cc/gm, and other properties comparable to that of Yarns 2 and 3 of Table I.

I claim:

1. A crimped polyamide staple filament mixture comprising (a) 40–60% by weight of trilobal filaments having a modification ratio within the range of 1.6–1.9, and (b) 40–60% by weight of trilobal filaments having a modification ratio within the range of 2.2–2.5.

2. A crimped polyamide staple yarn having high bulk, high luster and improved resistance to soiling, comprising a blend of (a) 40–60% by weight of trilobal filaments having a modification ratio within the range of 1.6–1.9, and (b) 40–60% by weight of trilobal filaments having a modification ratio within the range of 2.2–2.5.

3. A crimped polyamide staple yarn in accordance with claim 2 which contains as part of the blend up to 5% of multilobal filaments having a modification ratio within the range of 1.4–2.8.

4. A crimped polyamide staple yarn in accordance with claim 2 which contains as part of the blend up to 5% of other filaments.

5. A crimped polyamide staple yarn in accordance with claim 2 containing 0–10% of a delusterant.

6. A crimped polyamide staple yarn in accordance with claim 5 wherein the delusterant is polyethylene oxide.

7. A crimped polyamide staple yarn in accordance with claim 6 wherein the delusterant is present in amounts within the range of 0.25–1%.

8. A method for producing the crimped polyamide staple filament mixture by mixing (a) 40–60% by weight of trilobal filaments having a modification ratio within the range of 1.6–1.9, and (b) 40–60% by weight of trilobal filaments having a modification ratio within the range of 2.2–2.5.

9. In a method for producing crimped polyamide staple yarn having high bulk, high luster and improved resistance to soiling by a combination of steps including meltspinning continuous polyamide filaments, drawing the filaments, crimping the filaments, cutting the crimped filaments into staple, wherein the improvement resides in blending filaments comprising (a) 40–60% by weight of trilobal filaments having a modification ratio within the range of 1.6–1.9, and (b) 40–60% by weight of trilobal filaments having a modification ratio within the range of 2.2–2.5, said blending being performed during one or more stages in the production of staple yarn.

10. A method in accordance with claim 9 wherein the blending is performed in the drawing stage.

11. A method in accordance with claim 9 wherein the blending is performed after cutting to staple.

12. A method in accordance with claim 9 wherein the steps include combining the trilobal filaments with up to 5% of other staple filaments.

* * * * *